US007755585B2

(12) United States Patent
Kim

(10) Patent No.: US 7,755,585 B2
(45) Date of Patent: Jul. 13, 2010

(54) PIXEL AND ORGANIC LIGHT EMITTING DISPLAY DEVICE USING THE SAME

(75) Inventor: Yang Wan Kim, Seoul (KR)

(73) Assignee: Samsung Mobile Display Co., Ltd., Yongin-si (KR)

( * ) Notice: Subject to any disclaimer, the term of this patent is extended or adjusted under 35 U.S.C. 154(b) by 897 days.

(21) Appl. No.: 11/520,506

(22) Filed: Sep. 12, 2006

(65) Prior Publication Data

US 2007/0103406 A1 May 10, 2007

(30) Foreign Application Priority Data

Nov. 9, 2005 (KR) ..... 10-2005-0107199

(51) Int. Cl.
*G09G 3/30* (2006.01)
*G09G 3/36* (2006.01)

(52) U.S. Cl. ..... 345/92; 345/76

(58) Field of Classification Search ..... 345/76–81, 345/92; 315/169.3; 313/463, 504
See application file for complete search history.

(56) References Cited

U.S. PATENT DOCUMENTS

| | | | | |
|---|---|---|---|---|
| 7,411,571 | B2 * | 8/2008 | Huh | 345/80 |
| 7,450,092 | B2 * | 11/2008 | Kim et al. | 345/76 |
| 7,649,515 | B2 * | 1/2010 | Ozawa et al. | 345/82 |
| 7,656,369 | B2 * | 2/2010 | Chung et al. | 345/80 |
| 2005/0104815 | A1 | 5/2005 | Komiya et al. | |
| 2006/0267884 | A1 * | 11/2006 | Takahashi et al. | 345/76 |

FOREIGN PATENT DOCUMENTS

| | | | |
|---|---|---|---|
| EP | 1 536 405 | A2 | 10/2004 |
| EP | 1 496 495 | A2 | 1/2005 |
| EP | 1 580 722 | A2 | 9/2005 |
| KR | 10-2004-0020461 | | 3/2004 |
| KR | 10-2005-0005646 | | 1/2005 |
| KR | 10-2005-0049686 | | 5/2005 |

(Continued)

OTHER PUBLICATIONS

European Search Report dated Nov. 9, 2007 for corresponding European Patent Application No. 0625575.7 indicating relevance of references in this IDS.

(Continued)

*Primary Examiner*—Jimmy H Nguyen
(74) *Attorney, Agent, or Firm*—Christie, Parker & Hale, LLP

(57) ABSTRACT

A pixel for displaying an image with uniform brightness is provided. The pixel includes an organic light emitting diode (OLED) that is driven by a pixel circuit. The pixel circuit is coupled to a data line, two scan lines, and an emission control line of a display device. The pixel is provided with power from external power supply sources and an initialization voltage source. The pixel circuit includes transistors and a storage capacitor that maintains a voltage at a gate of a driving transistor masking any variation between the threshold voltages of the driving transistors used in various pixels. An alternative embodiment, modifies a leakage path from the gate of the driving transistor to the initialization voltage source. Substantial impact of the leakage is shifted from the gate to drain of the driving transistor. As a result, a substantially uniform brightness is maintained in each pixel.

20 Claims, 5 Drawing Sheets

FOREIGN PATENT DOCUMENTS

| | | |
|---|---|---|
| KR | 10-2005-0049827 | 5/2005 |
| KR | 10-2005-0051300 | 6/2005 |
| KR | 10-2005-0052033 | 6/2005 |

OTHER PUBLICATIONS

Choi et al, "P-11: An Improved Voltage Programmed Pixel Structure for Large Size and High Resolution AM-OLED Displays"; Division of Electrical and Computer Engineering, Hanyang University, Seoul, Korea, May 25, 2004.

Korean Patent Abstracts for publication No. 1020050049827 A; dated May 27, 2005 in the name of Yang Wan Kim et al.

Korean Patent Abstract for Korean Publication No. 1020040020461 A, published Mar. 9, 2004 in the name Shang Li Chen, et al.

Korean Patent Abstract for Korean Publication No. 1020050005646 A, published Jan. 14, 2005 in the name of Sang Moo Choi, et al.

* cited by examiner

PIXEL AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2005-0107199, filed on Nov. 9, 2005, in the Korean Intellectual Property Office, the entire content of which is incorporated herein by reference.

BACKGROUND

1. Field of the Invention

The present invention relates to a pixel and an organic light emitting display device using the same, and more particularly, to a pixel for displaying an image with uniform brightness and an organic light emitting display device using the same.

2. Discussion of Related Art

FIG. 1 is a circuit diagram illustrating a pixel of a conventional organic light emitting display device. The pixel 4 of the conventional organic light emitting display device includes a pixel circuit 2 coupled to an organic light emitting diode (OLED), a data line Dm, and a scan line Sn. The pixel circuit 2 controls the OLED. A first power source ELVDD and a second power source ELVSS are coupled to the pixel 4.

An anode electrode of the OLED is coupled to the pixel circuit 2 and a cathode electrode of the OLED is coupled to the second power source ELVSS. The OLED generates light with brightness corresponding to the current supplied by the pixel circuit 2.

The pixel circuit 2 controls the amount of current supplied to the OLED in response to a data signal supplied to the data line Dm when a scan signal is supplied to the scan line Sn. In order to perform this operation, the pixel circuit 2 includes a first transistor M1, a second transistor M2, and a storage capacitor Cst. The second transistor M2 is coupled between the first power source ELVDD and the OLED. The first transistor M1 is coupled to the second transistor M2, the data line Dm, and the scan line Sn. The storage capacitor Cst is coupled between a gate electrode and a first electrode of the second transistor M2.

A gate electrode of the first transistor M1 is coupled to the scan line Sn and a first terminal of the first transistor M1 is coupled to the data line Dm. A second electrode of the first transistor M1 is coupled to one terminal of the storage capacitor Cst. One of the electrodes of each of the first and second transistors M1, M2 is set as a source electrode and the other electrode is set as a drain electrode. For example, when the first electrode is set as the source electrode, the second electrode is set as the drain electrode. When the scan signal is supplied by the scan line Sn, the first transistor M1 is turned on to supply the data signal supplied by the data line Dm to the storage capacitor Cst. As a result, a voltage corresponding to the data signal is charged in the storage capacitor Cst.

The gate electrode of the second transistor M2 is coupled to one terminal of the storage capacitor Cst and the first electrode of the second transistor M2 is coupled to the other terminal of the storage capacitor Cst and the first power source ELVDD. The second electrode of the second transistor M2 is coupled to the anode electrode of the OLED. The second transistor M2 controls the amount of current that flows from the first power source ELVDD to the OLED to correspond to the voltage value stored in the storage capacitor Cst. The OLED generates light with the brightness corresponding to the amount of current supplied by the second transistor M2.

However, according to the above-described conventional pixel 4, it may not be possible to display an image with uniform brightness. To be specific, the threshold voltages of the second transistors M2 included in different pixels 4 vary due to deviations introduced during the fabrication processes. When the threshold voltages of the second transistors M2 are not uniform, although data signals corresponding to the same gray level are supplied to a number of pixels 4, light components with different brightness are generated by the OLEDs of each pixel 4. The difference in brightness is due to the difference between the threshold voltages of the second transistors M2 of each pixel.

SUMMARY OF THE INVENTION

Accordingly, the present invention provides a pixel for displaying an image with uniform brightness and a light emitting display device using the same.

One embodiment provides a pixel comprising an organic light emitting diode (OLED) that is driven by a first transistor. A second transistor has a first electrode that is coupled to a data line and a gate coupled to a first scan line. The second transistor is to be turned on when a first scan signal is supplied to the first scan line. A storage capacitor has a first terminal is coupled to a second electrode of the second transistor. The first transistor is coupled to a second terminal of the storage capacitor to supply current corresponding to a value of the voltage applied to the second terminal of the storage capacitor from a first power source to a second power source through the OLED. A third transistor is coupled between the second terminal of the storage capacitor and the second electrode of the first transistor and is turned on when the first scan signal is being supplied. A fourth transistor is coupled between the second electrode of the first transistor and an initialization power source and is turned on when a second scan signal is being supplied to a second scan line. A fifth transistor is coupled between the first terminal of the storage capacitor and the initialization power source and is turned on while an emission control signal is not being supplied to an emission control line. The transistors may be of different conductivity types. The voltages of the first and second scan signal and the emission control signal vary depending on the conductivity type of the transistors used in the pixel.

Another embodiment provides an organic light emitting display device including a scan driving part supplying first scan signals to first scan lines, supplying second scan signals to second scan lines, and supplying emission control signals to emission control lines, a data driving part supplying data signals to data lines, and a display region including a pixel or a plurality of pixels coupled to the first scan lines, the second scan lines, and the data lines. Each of the pixels includes an OLED that is driven by a first transistor. A second transistor is coupled to a data line and a first scan line and is turned on when a first scan signal is supplied to the first scan line. A storage capacitor having a first terminal is coupled to a second electrode of the second transistor. The first transistor is coupled to a second terminal of the storage capacitor and supplies a current from a first power source to a second power source through the OLED. The current provided by the first transistor corresponds to a value of a voltage applied to the second terminal of the storage capacitor. A third transistor is coupled between the second terminal of the storage capacitor and the second electrode of the first transistor and is turned on when the first scan signal is being supplied. A fourth transistor is coupled between the second electrode of the first transistor and an initialization power source and is turned on when a second scan signal is being supplied to a second scan line. A fifth transistor is coupled between the first terminal of the storage capacitor and the initialization power source and is turned on while an emission control signal is not being supplied to an emission control line. In this embodiment, also, the transistors used may be of different conductivity types. Therefore, scan and emission control signals of appropriate voltage are applied to turn on or turn off each transistor based on its conductivity type.

In an organic light emitting display device including a plurality of pixels, the first scan signal, the second scan signal, and the emission control signal may be each applied in a sequential manner to their respective scan lines or to the emission control lines. In another embodiment, the first scan signal and the second scan signal may be two successive scan signals being applied to two adjacent scan lines as a part of a sequential application of the scan signal to the scan lines.

DETAILED DESCRIPTION

Figure 1:
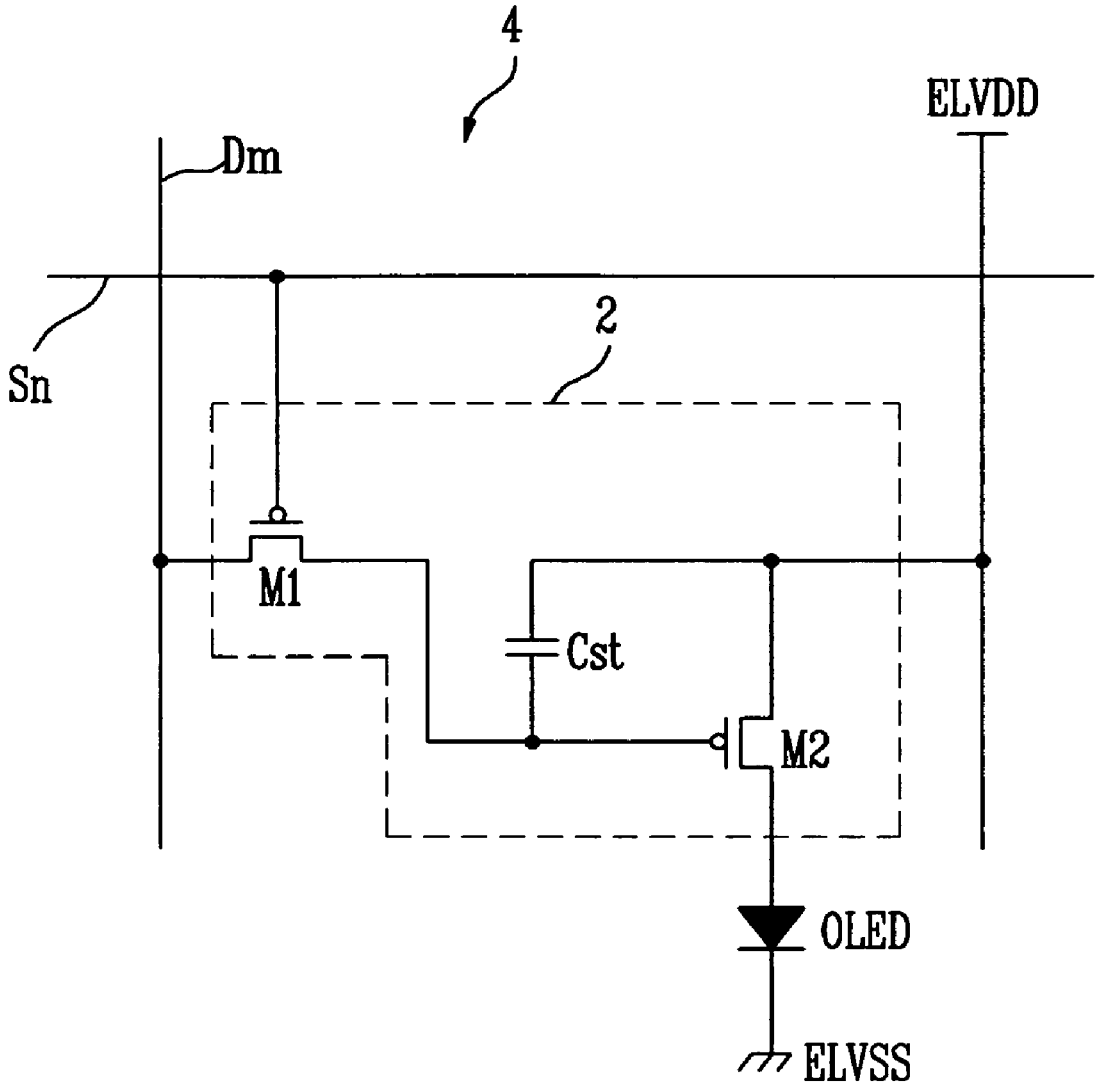
FIG. 1 (PRIOR ART)
FIG. 1 is a schematic circuit diagram illustrating a conventional pixel.
Figure 2:
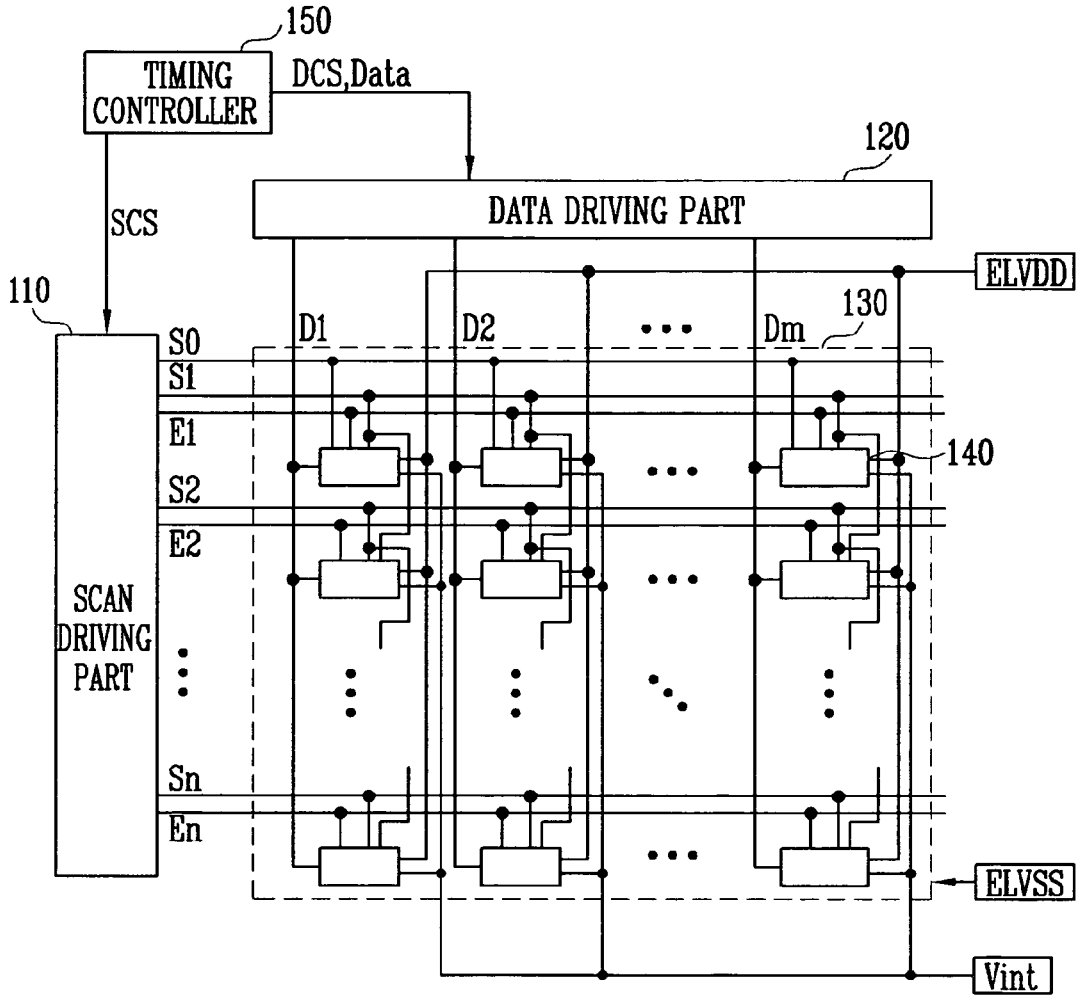
FIG. 2 schematically illustrates an organic light emitting display device according to a first embodiment of the present invention.

FIG. 2 schematically illustrates an organic light emitting display device according to a first embodiment of the present invention.

The organic light emitting display device according to the first embodiment of the present invention includes a scan driving part 110 for driving scan lines S1 to Sn and emission control lines E1 to En, a data driving part 120 for driving data lines D1 to Dm, a display region 130 including pixels 140 formed in the regions partitioned by the scan lines S1 to Sn and the data lines D1 to Dm, and a timing controller 150 for controlling the scan driving part 110 and the data driving part 120.

The timing controller 150 receives data Data and synchronizing signals (not shown) from outside of the display device. The timing controller 150 generates data driving control signals DCS and scan driving control signals SCS corresponding to the synchronizing signals supplied from outside. The data driving control signals DCS generated by the timing controller 150 are supplied to the data driving part 120 and the scan driving control signals SCS generated by the timing controller 150 are supplied to the scan driving part 110. The timing controller 150 supplies the data Data supplied from the outside to the data driving part 120.

The scan driving part 110 receives the scan driving control signals SCS from the timing controller 150. The scan driving part 110 that has received the scan driving control signals SCS, generates scan signals to be supplied to the scan lines S1 to Sn. Also, in response to the scan driving control signals SCS, the scan driving part 110 generates emission control signals to be supplied to the emission control lines E1 to En. The scan signals may be generated in a sequential manner. The width of the emission control signals is equal to or larger than the width of the scan signals.

The width of a signal may refer to the duration of a pulse of the signal. Some signals may have pulses that correspond to a voltage level below a reference level and other signals may have pulses corresponding to a voltage level above the reference level. For example, some signals may have positive pulses and other signals may have negative pulses. If the signals are being applied to gates of transistors for controlling the transistors, then negative pulses turn on PMOS transistors and positive pulses turn on NMOS transistors. Alternatively, if a signal includes positive pulses, then the positive pulses of the signal may be used to turn off a PMOS transistor.

The data driving part 120 receives the data driving control signals DCS from the timing controller 150. The data driving part 120 that has received the data driving control signals DCS generates data signals to be supplied to the data lines D1 to Dm in synchronization with the scan signals.

The display region 130 receives power from a first power source ELVDD and a second power source ELVSS and supplies the power to the pixels 140. The pixels 140 that have received power from the first power source ELVDD and the second power source ELVSS generate light components corresponding to the data signals. The emission times, or duration of emission, of the pixels 140 are controlled by the emission control signals.

Figure 3:
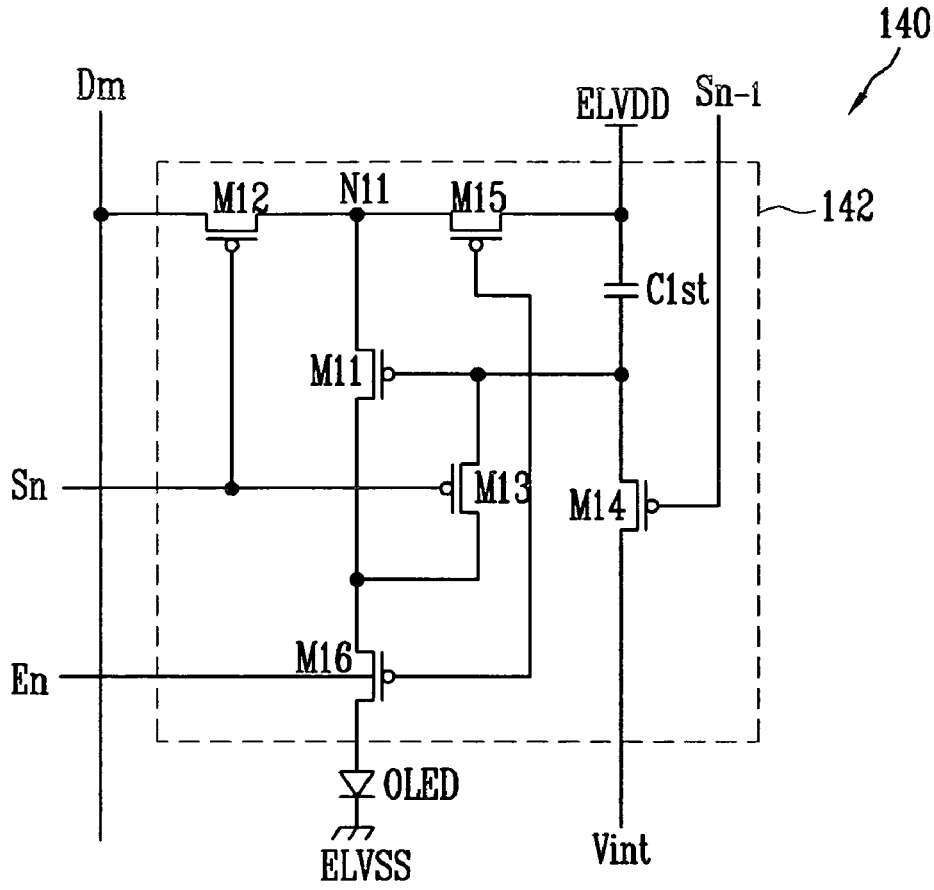
FIG. 3 is a schematic circuit diagram illustrating a first embodiment of a pixel according to the present invention.

FIG. 3 is a schematic circuit diagram illustrating a first embodiment pixel according to the present invention. The first embodiment pixel 140 may be included in the display device of the first embodiment of the present invention that is shown FIG. 2. For convenience sake, a pixel 140 coupled to an mth data line Dm, an nth scan line Sn, an (n−1)th scan line Sn−1, and an nth emission control line En is illustrated in FIG. 3.

The pixel 140 includes a pixel circuit 142 that is coupled to the OLED, and also to the data line Dm, the scan lines Sn−1 and Sn, and the emission control line En to control the amount of current supplied to the OLED.

An anode electrode of the OLED is coupled to the pixel circuit 142 and a cathode electrode of the OLED is coupled to the second power source ELVSS. The voltage value of the second power source ELVSS is set to be smaller than the voltage value of the first power source ELVDD. The OLED generates light with brightness corresponding to the amount of current supplied by the pixel circuit 142.

The pixel circuit 142 controls the amount of current supplied to the OLED in response to the data signal supplied to the data line Dm when a scan signal is supplied to the scan line Sn. The pixel circuit 142 includes first to sixth transistors M11, M12, M13, M14, M15, M16 and a storage capacitor C1st.

A first electrode of the second transistor M12 is coupled to the data line Dm and a second electrode of the second transistor M12 is coupled to a first node N11. A gate electrode of the second transistor M12 is coupled to the nth scan line Sn. When the scan signal is supplied to the nth scan line Sn, the second transistor M12 is turned on to supply the data signal supplied from the data line Dm to the first node N11.

A first electrode of the first transistor M11 is coupled to the first node N11 and a second electrode of the first transistor M11 is coupled to a first electrode of the sixth transistor M16. A gate electrode of the first transistor M11 is coupled to the storage capacitor C1st. The first transistor M11 supplies the current corresponding to the voltage charged in the storage capacitor C1st to the OLED.

A first electrode of the third transistor M13 is coupled to the second electrode of the first transistor M11 and a second electrode of the third transistor M13 is coupled to the gate electrode of the first transistor M11. A gate electrode of the third transistor M13 is coupled to the nth scan line Sn. When the scan signal is supplied to the nth scan line Sn, the third transistor M13 is turned on, the first transistor M11 serves as a diode, and current flow is established through the first transistor M11.

A gate electrode of the fourth transistor M14 is coupled to the (n−1)th scan line Sn−1 and a first electrode of the fourth transistor M14 is coupled to one terminal of the storage capacitor C1st and the gate electrode of the first transistor M1. A second electrode of the fourth transistor M14 is coupled to an initialization power source Vint. When the scan signal is supplied to the (n−1)th scan line Sn−1, the fourth transistor M14 is turned on to change the voltages of the terminal of the storage capacitor C1st coupled to the fourth transistor M14 and the gate electrode of the first transistor M11 to the voltage of the initialization power source Vint.

A first electrode of the fifth transistor M15 is coupled to the first power source ELVDD and a second electrode of the fifth transistor M15 is coupled to the first node N11. A gate electrode of the fifth transistor M15 is coupled to the emission control line En. When the emission control signal is not being supplied by the emission control line En, the fifth transistor M15 is turned on to electrically connect the first power source ELVDD and the first node N11 to each other.

The first electrode of the sixth transistor M16 is coupled to the second electrode of the first transistor M11 and a second electrode of the sixth transistor M16 is coupled to the anode electrode of the OLED. A gate electrode of the sixth transistor M16 is coupled to the emission control line En. When the emission control signal is not being supplied, the sixth transistor M16 is turned on to supply the current supplied by the first transistor M11 to the OLED.

Figure 4:
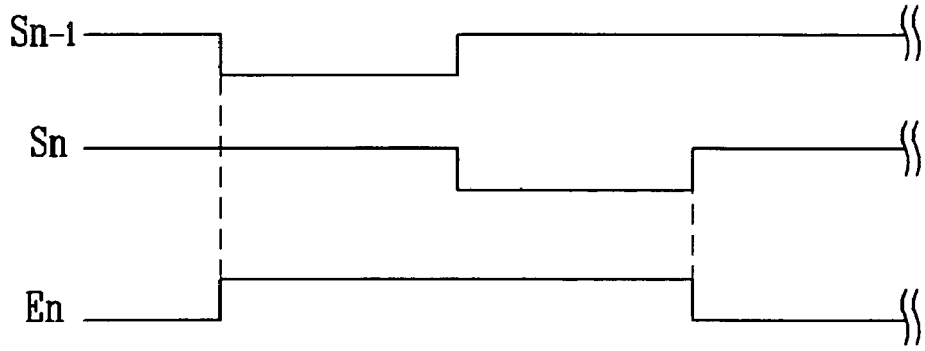
FIG. 4 schematically illustrates waveforms for describing a method of driving the pixel of FIG. 3.

The operation of the pixel 140 will be described in detail with reference to waveforms of FIG. 4. FIG. 4 shows the waveforms of the signals applied to the (n−1)th scan line Sn−1, the nth scan line Sn, and the nth emission control line En. First, a scan signal is supplied to the (n−1)th scan line Sn−1 so that the fourth transistor M14 is turned on. When the fourth transistor M14 is turned on, the voltage of the initialization power source Vint is supplied to one terminal of the storage capacitor C1st and the gate terminal of the first transistor M11, that are both coupled to the first electrode of the fourth transistor M14. That is, when the fourth transistor M14 is turned on, the voltages of one terminal of the storage capacitor C1st and the gate terminal of the first transistor M11 are initialized to the voltage of the initialization power source Vint. For the exemplary embodiment shown in FIG. 3, the voltage value of the initialization power source Vint is set to be smaller than the voltage value of the data signal.

Then, the scan signal is supplied to the nth scan line Sn. When the scan signal is supplied to the nth scan line Sn, the second and third transistors M12, M13 are turned on. When the third transistor M13 is turned on, current flows through the first transistor M11 so that the first transistor M11 serves as a diode. When the second transistor M12 is turned on, the data signal supplied to the data line Dm is supplied to the first node N11 through the second transistor M12. At this time, because the voltage at the gate of the first transistor M11 is initialized to the voltage of the initialization power source Vint and because the voltage of Vint is set to be lower than the voltage of the data signal supplied to the first node N11, the first transistor M11 is turned on.

When the first transistor M11 is turned on, the data signal applied to the first node N11 is supplied to the terminal of the storage capacitor C1st, that is coupled to the gate of the first transistor M11, through the first and third transistors M11, M13. The data signal is supplied to the storage capacitor C1st through the first transistor M11 which serves as a diode and through which current flows. Therefore, the voltage corresponding to the data signal and a threshold voltage of the first transistor M11 is charged in the storage capacitor C1st.

After the voltage corresponding to the data signal and the threshold voltage of the first transistor M11 is charged in the storage capacitor C1st, supply of the emission control signal is stopped so that the fifth and sixth transistors M15, M16 are turned on. When the fifth and sixth transistors M15, M16 are turned on, a current path from the first power source ELVDD to the OLED is formed. In this case, the first transistor M11 controls the amount of current that flows from the first power source ELVDD to the OLED to correspond to the voltage charged in the storage capacitor C1st.

As described above, the voltage corresponding to the data signal and the threshold voltage of the first transistor M11 is charged in the storage capacitor C1st included in the pixel 140. The voltages charged in the storage capacitors C1st of different pixels 140 may be different because threshold voltages of the first transistors M11 used in each pixel may be different from one another. However, the threshold voltage is included in the voltage charging the capacitor. As a result, it is possible to control the amount of current that flows to the OLED regardless of the threshold voltage of the first transistor M11. Therefore, various pixels 140 according to the first embodiment of the present invention can display an image with substantially uniform brightness regardless of the threshold voltages of the first transistors M11 used in each of the pixels 140.

However, in the pixel 140 according to the first embodiment of the present invention, undesired leakage current may originate from the gate terminal of the first transistor M11. To be specific, when the fourth transistor M14 is off, the voltage of the gate electrode of the first transistor M11 is different from the voltage of the initialization power source Vint. As described above, when the voltage of the gate electrode of the first transistor M11 is different from the voltage of the initialization power source Vint, although the fourth transistor M14 is turned off, a leakage current is generated that changes the voltage of the gate electrode of the first transistor M11. That is, in the pixel 140 illustrated in FIG. 3, the voltage of the gate electrode of the first transistor M11 is changed by the leakage current through the fourth transistor M14 so that an image with desired brightness is not displayed.

Figure 5:
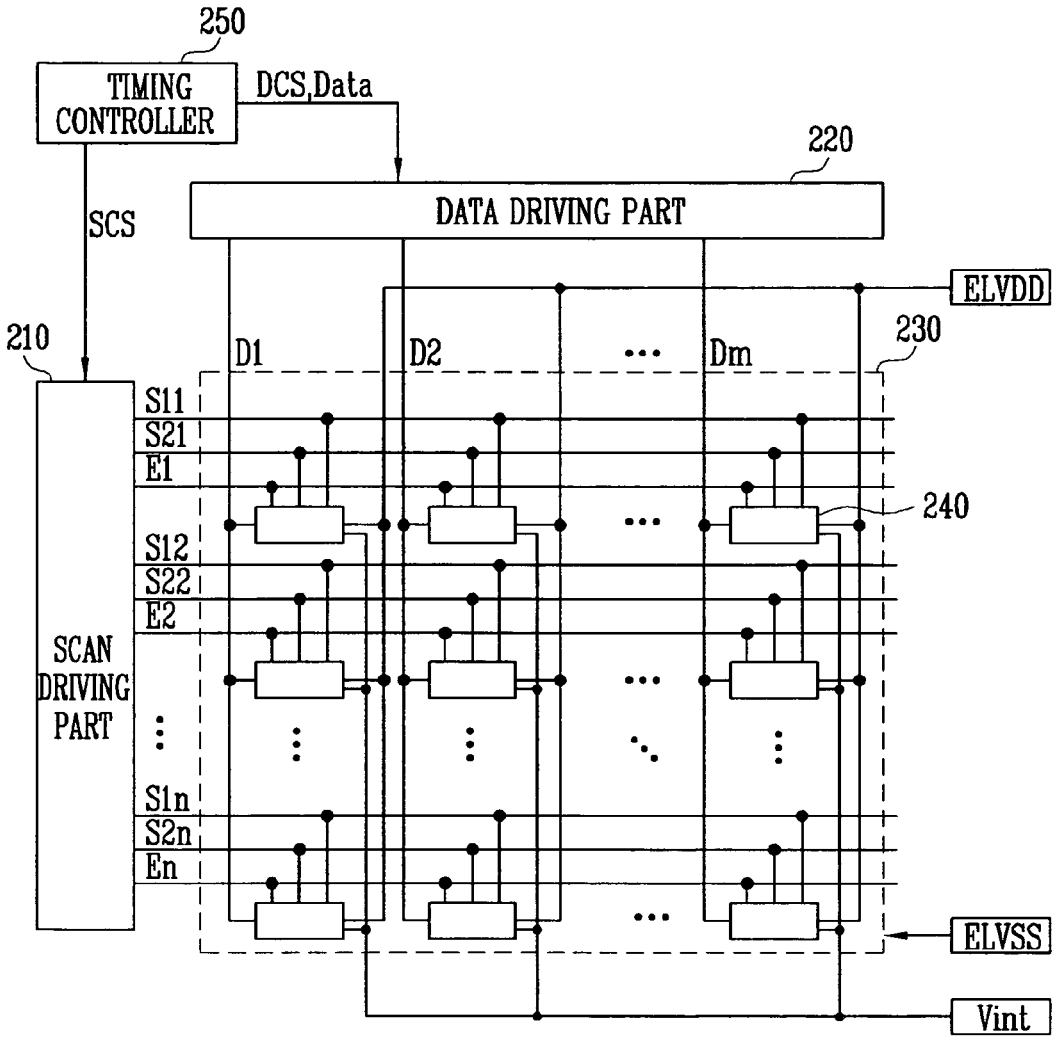
FIG. 5 schematically illustrates an organic light emitting display device according to a second embodiment of the present invention.

FIG. 5 illustrates an organic light emitting display device according to a second embodiment of the present invention.

The organic light emitting display device according to the second embodiment of the present invention includes a scan driving part 210, a data driving part 220, a display region 230, and a timing controller 250. The scan driving part 210 drives first scan lines S11 to S1*n*, second scan lines S21 to S2*n*, and emission control lines E1 to En. The data driving part 220 drives data lines D1 to Dm. The display region 230 includes pixels 240 formed in regions partitioned by the first scan lines S11 to S1*n*, the second scan lines S21 to S2*n*, and the data lines D1 to Dm. The timing controller 250 controls the scan driving part 210 and the data driving part 220.

The timing controller 250 generates data driving control signals DCS and scan driving control signals SCS in response to synchronizing signals supplied from the outside of the display device. The data driving control signals DCS generated by the timing controller 250 are supplied to the data driving part 220 and the scan driving control signals SCS generated by the timing controller 250 are supplied to the scan driving part 210. The timing controller 250 supplies data Data supplied from the outside to the data driving part 220.

The scan driving part 210 receives the scan driving control signals SCS from the timing controller 250. The scan driving part 210 that has received the scan driving control signals SCS supplies a first scan signal to the first scan lines S11 to S1*n* and supplies a second scan signal to the second scan lines S21 to S2*n*. The first scan signals may be supplied to the first scan lines S11 to S1*n* in a sequential manner. Similarly, the second scan signals may be supplied to the second scan lines S21 to S2*n* in a sequential manner. The first and second scan signals supplied to the same pixel 240 are supplied at substantially the same point in time and a width or duration of the first scan signal is set to be larger than a width of the second scan signal. Thus, the first scan signal lasts longer than the second scan signal. The scan driving part 210 generates emission control signals in response to the scan driving control signals SCS and supplies the generated emission control signals to the emission control lines E1 to En. The emission control signals are supplied to overlap the first scan signals. Further, the width or duration of the emission control signal is set to be larger than the width of the first scan signal.

The data driving part 220 receives the data driving control signals DCS from the timing controller 250. The data driving part 220, that has received the data driving control signals DCS, generates data signals and supplies the generated data signals to the data lines D1 to Dm in synchronization with the first and second scan signals.

The display region 230 receives power from a first power source ELVDD, a second power source ELVSS and an initialization power source Vint located outside the display region 230. The display region 230 supplies the power from the first power source ELVDD, the second power source ELVSS, and the initialization power source Vint to the pixels 240. The pixels 240 that have received power from the first power source ELVDD, the second power source ELVSS, and the initialization power source Vint, generate light components corresponding to the data signals. The emission times, including the time of commencing the emission and the duration of emission, of the pixels 240 are controlled by the emission control signals.

Figure 6:
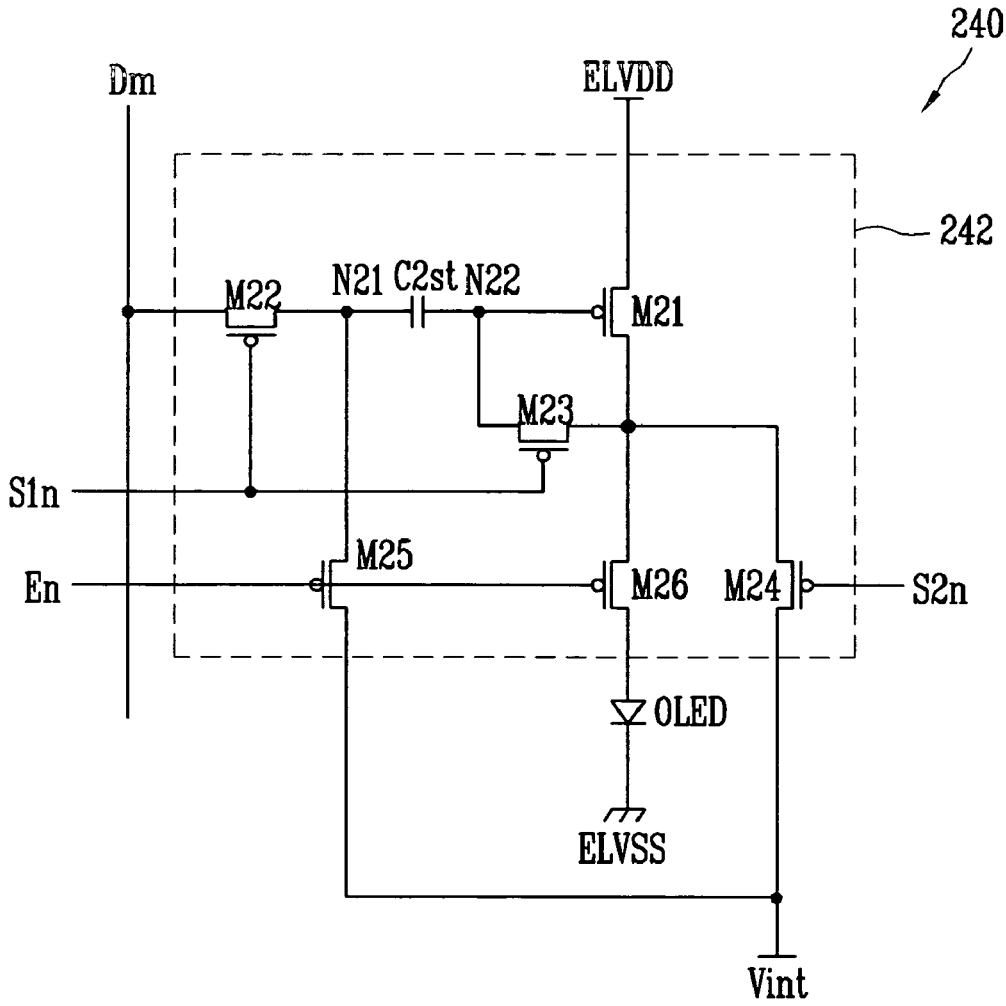
FIG. 6 is a schematic circuit diagram illustrating a second embodiment of a pixel according to the present invention.

FIG. 6 is a circuit diagram illustrating a second embodiment of a pixel 240 according of the present invention. The second embodiment pixel 240 may be included in the display device of the second embodiment of the present invention shown in FIG. 5. For convenience sake, a pixel coupled to an mth data line Dm, an nth first scan line S1*n*, an nth second scan line S2*n*, and an nth emission control line En is illustrated in FIG. 6.

The pixel 240 according to the second embodiment of the present invention includes a pixel circuit 242 coupled to an OLED, the data line Dm, the first and second scan lines S1*n*, S2*n*, and the emission control line En to control the amount of current supplied to the OLED.

The anode electrode of the OLED is coupled to the pixel circuit 242 and the cathode electrode of the OLED is coupled to the second power source ELVSS. The voltage value of the second power source ELVSS is set to be smaller than the voltage value of the first power source ELVDD. The OLED generates light with brightness corresponding to the amount of current supplied by the pixel circuit 242.

The pixel circuit 242 receives the data signal from the data line Dm when the scan signals are supplied to the first and second scan lines S1*n* and S2*n*. The pixel circuit 242 controls the amount of current supplied to the OLED in response to the data signal. To provide a controlled current to the OLED, the pixel circuit 242 includes first to sixth transistors M21, M22, M23, M24, M25, M26 and a storage capacitor C2st.

A first electrode of the second transistor M22 is coupled to the data line Dm and a second electrode of the second transistor M22 is coupled to a first node N21. A gate electrode of the second transistor M22 is coupled to the first scan line S1*n*. The second transistor M22 is turned on when the first scan signal is supplied to the first scan line S1*n*. When turned on, the second transistor M22 supplies the data signal, that is supplied to the data line Dm, to the first node N21.

A first electrode of the first transistor M21 is coupled to the first power source ELVDD and a second electrode of the first transistor M21 is coupled to a first electrode of the sixth transistor M26. A gate electrode of the first transistor M21 is coupled to a second node N22. The first transistor M21 supplies the current corresponding to the voltage applied to the second node N22 to the OLED. The current supplied by the first transistor M21 to the OLED corresponds to and is controlled by the voltage at the second node N22.

A first electrode of the third transistor M23 is coupled to the second electrode of the first transistor M21 and a second electrode of the third transistor M23 is coupled to the gate electrode of the first transistor M21. A gate electrode of the third transistor M23 is coupled to the first scan line S1*n*. The third transistor M23 is turned on when the first scan signal is supplied to the first scan line S1*n*. When the third transistor M23 is turned on, the first transistor M21 serves as a diode.

A first electrode of the fourth transistor M24 is coupled to the second electrode of the first transistor M21 and a second electrode of the fourth transistor M24 is coupled to the initialization power source Vint. A gate electrode of the fourth transistor M24 is coupled to the second scan line S2*n*. The fourth transistor M24 is turned on when the second scan signal is supplied to the second scan line S2*n*.

A first electrode of the fifth transistor M25 is coupled to the first node N21 and a second electrode of the fifth transistor M25 is coupled to the initialization power source Vint. A gate electrode of the fifth transistor M25 is coupled to the emission control line En. In the exemplary embodiment shown, the fifth transistor M25 is turned on when the emission control signal is not being supplied by the emission control line En. When turned on, the fifth transistor M25 changes the voltage value of the first node N21 to the voltage value of the initialization power source Vint.

The first electrode of the sixth transistor M26 is coupled to the second electrode of the first transistor M21 and a second electrode of the sixth transistor M26 is coupled to the anode electrode of the OLED. A gate electrode of the sixth transistor M26 is coupled to the emission control line En. In the exemplary embodiment shown, the sixth transistor M26 is turned on when the emission control signal is not supplied. When turned on, the sixth transistor M26 supplies the current supplied by the first transistor M21 to the OLED.

The storage capacitor C2st is provided between the first node N21 and the second node N22 to be charged to a voltage established between these two nodes N21, N22.

Figure 7:
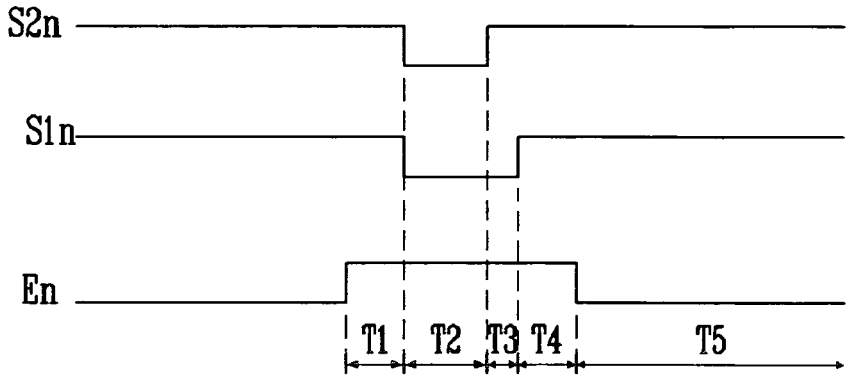
FIG. 7 schematically illustrates waveforms for describing a method of driving the pixel of FIG. 6.

The operations of the pixel 240 will be described in detail with reference to the waveforms of FIG. 7. Waveforms of FIG. 7 include a second scan signal being applied to the second scan line S2*n*, a first scan signal being applied to the first scan line S1*n*, and an emission control signal being applied to the emission control line En. First, the emission control signal is supplied to the emission control line En during a first period T1. When the emission control signal is being supplied to the emission control line En, the fifth and sixth transistors M25, M26 are turned off.

In the exemplary embodiments shown, the transistors are shown as PMOS transistors that are turned on by a negative gate to source voltage and turned off by a positive gate to source voltage. Also, in the exemplary embodiment shown, the emission control signal being supplied to the emission control line En is shown to be a positive signal. Accordingly, application of the positive signal to the emission control line turns off the PMOS transistors. In alternative embodiments, other types of transistors, for example NMOS transistors, may be used which are turned on and off by signals different from those shown.

In the embodiment shown, while the first scan signal is supplied during periods T2 and T3, the second scan signal is supplied only during the period T2. In other words, the first and second scan signals of the second embodiment coincide partially in time during the period T2. After the fifth and sixth transistors M25, M26 are turned off, the first scan signal is supplied to the first scan line S1*n* and, at the same time, the second scan signal is supplied to the second scan line S2*n*. When the first scan signal is being supplied, the second and third transistors M22, M23 are turned on. When the second scan signal is being supplied, the fourth transistor M24 is turned on. When the second transistor M22 is turned on, the data signal supplied to the data line Dm is supplied to the first node N21. When the third and fourth transistors M23, M24 are turned on together, the voltage of the initialization power source Vint is supplied to the second node N22. In the exemplary embodiment shown, the voltage value of the initialization power source Vint is set to be smaller than the voltage value of the data signal.

Then, during a third period T3, supply of the second scan signal to the second scan line S2*n* is stopped. As a result, the fourth transistor M24 is turned off. At this time, because current flows through the third transistor M21 so that the first transistor M21 serves as a diode, the voltage value of the second node N22 is obtained by subtracting the threshold voltage value of the first transistor M21 from the voltage value of the first power source ELVDD. The storage capacitor C2st is charged to the voltage difference between the first node N21 and the second node N22.

During a fourth period T4, supply of the first scan signal to the first scan line S1*n* is stopped. Then, the second and third transistors M22, M23 are turned off.

During a fifth period T5, supply of the emission control signal is stopped. Then, the fifth transistor M25 and the sixth transistor M26 are turned on. When the fifth transistor M25 is turned on, the voltage value of the first node N21 is reduced to the voltage value of the initialization power source Vint. That is, the voltage value of the first node N21 is reduced from the voltage value of the data signal to the voltage value of the initialization power source Vint. In this case, because the third transistor M23 is off and the second node N22 is floating, the voltage value of the second node N22 is reduced corresponding to the reduction in the voltage value of the first node N21 in order to maintain the same voltage difference between the two nodes N22, N21. For example, when the voltage at the first node N21 is reduced by the voltage value of the data signal, then the voltage value of the second node N22 is also reduced by the voltage value of the data signal from its previous voltage value that was obtained by subtracting the threshold voltage value of the first transistor M21 from the voltage value of the first power source ELVDD.

Then, the first transistor M21 supplies current corresponding to the value of the voltage applied to the second node N22 to the OLED through the sixth transistor M26 during the fifth period T5 so that light of controlled brightness is generated by the OLED. The first to fifth periods, T1, T2, T3, T4, T5 are consecutive in the exemplary embodiment of FIG. 7.

In the pixel 240 according to the second embodiment of the present invention, the voltage value of the second node N22 is initially set as the value obtained by subtracting the threshold voltage value of the first transistor M21 from the voltage value of the first power source ELVDD. The voltage value of the second node N22 is subsequently reduced from the initially set voltage value by the voltage value corresponding to the voltage value of the data signal. The second node N22 is coupled to the gate of the first transistor M21 and the voltage at the second node N22 determines the amount of current supplied to the OLED by the first transistor M21. As a result, in the pixel 240 according to the second embodiment of the present invention, it is possible to control the amount of current that flows to the OLED regardless of the threshold voltage value of the first transistor M21. Therefore, the pixel 240 according to the second embodiment of the present invention can display an image with substantially uniform brightness regardless of the threshold voltage of the first transistor M21.

In the pixel 240 according to the second embodiment of the present invention, the fourth transistor M24 that supplies the initialization power source Vint is coupled to the second electrode of the first transistor M21. Therefore, the leakage current through the fourth transistor M24 is from the second electrode of the first transistor M21. As a result, leakage current does not flow from the second node N22 that is the gate electrode of the first transistor M21 to the initialization power source Vint so that it is possible to display an image with desired brightness.

As described above, in the pixel according to the embodiments of the present invention and the organic light emitting display device using the same, the amount of current that flows to the OLED is controlled regardless of the threshold voltage of the first transistor. Therefore, it is possible to display an image with uniform brightness. According to the present invention, because the fourth transistor for supplying the initialization power source is coupled to the second electrode of the first transistor, it is possible to reduce or prevent leakage current flowing from the gate electrode of the first transistor so that it is possible to display an image with desired brightness.

Although certain embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A pixel comprising:

an organic light emitting diode;

a storage capacitor having a first terminal and a second terminal;

a first transistor coupled to the second terminal of the storage capacitor for supplying a current from a first power source to a second power source through the organic light emitting diode, the current corresponding to a voltage at the second terminal of the storage capacitor, the first transistor having a first electrode coupled to the first power source;

a second transistor coupled between a data line and the first terminal of the storage capacitor and being controlled by a first scan signal supplied to a first scan line;

a third transistor coupled between the second terminal of the storage capacitor and a second electrode of the first transistor and being controlled by the first scan signal;

a fourth transistor coupled between the second electrode of the first transistor and an initialization power source and being controlled by a second scan signal supplied to a second scan line; and a fifth transistor coupled between the first terminal of the storage capacitor and the initialization power source and being controlled by an emission control signal supplied to an emission control line.

2. The pixel as claimed in claim 1, further comprising a sixth transistor coupled between the second electrode of the first transistor and the organic light emitting diode, the sixth transistor being controlled by the emission control signal.

3. The pixel as claimed in claim 2, wherein the second scan signal is supplied during a portion of a period of supplying the first scan signal to supply an initialization voltage through the fourth transistor to the second terminal of the storage capacitor while a data signal is being supplied through the second transistor to the first terminal of the storage capacitor.

4. The pixel as claimed in claim 3, wherein after supplying the second scan signal has stopped, a voltage at the second terminal of the storage capacitor is obtained by subtracting a threshold voltage of the first transistor from a voltage of the first power source.

5. The pixel as claimed in claim 4, wherein the emission control signal is supplied during periods when at least one of the first scan signal and the second scan signal is being supplied, and wherein the fifth transistor and the sixth transistor are turned off in response to the emission control signal.

6. The pixel as claimed in claim 5, wherein the initialization voltage is smaller than a voltage of the data signal.

7. The pixel as claimed in claim 6, wherein the second terminal of the storage capacitor is floating when the supply of the first scan signal is stopped.

8. The pixel as claimed in claim 7, wherein the voltage at the first terminal of the storage capacitor is reduced to the initialization voltage when the fifth transistor is turned on, and wherein the voltage at the second terminal of the storage capacitor is reduced corresponding to the reduction in the voltage at the first terminal of the storage capacitor.

9. An organic light emitting display device comprising:

a scan driving part for supplying first scan signals to first scan lines, supplying second scan signals to second scan lines, and supplying emission control signals to emission control lines;

a data driving part for supplying data signals to data lines; and a display region including a pixel coupled to a first scan line, to a second scan line, to an emission control line, and to a data line, wherein the pixel includes:

an organic light emitting diode;

a storage capacitor having a first terminal and a second terminal;

a first transistor coupled to the second terminal of the storage capacitor for supplying a current from a first power source to a second power source through the organic light emitting diode, the current corresponding to a voltage at the second terminal of the storage capacitor, the first transistor having a first electrode coupled to the first power source;

a second transistor coupled between the data line and the first terminal of the storage capacitor and being controlled by a first scan signal supplied to the first scan line;

a third transistor coupled between the second terminal of the storage capacitor and a second electrode of the first transistor and being controlled by the first scan signal;

a fourth transistor coupled between the second electrode of the first transistor and an initialization power source and being controlled by a second scan signal supplied to the second scan line; and a fifth transistor coupled between the first terminal of the storage capacitor and the initialization power source and being controlled by an emission control signal supplied to the emission control line.

10. The organic light emitting display device as claimed in claim 9, further comprising a sixth transistor coupled between the second electrode of the first transistor and the organic light emitting diode and being controlled by the emission control signal.

11. The organic light emitting display device as claimed in claim 9, wherein the scan driving part is configured to supply the first and second scan signals such that supplying of the first scan signal to the first scan line begins substantially simultaneously with supplying of the second scan signal to the second scan line, and wherein a duration of the supplying of the first scan signal to the first scan line is longer than a duration of the supplying of the second scan signal to the second scan line.

12. The organic light emitting display device as claimed in claim 11, wherein the scan driving part is configured to supply the light emission control signal such that a period of supplying of the emission control signal to the emission control line overlaps a period of the supplying of the first scan signal to the first scan line, and wherein a duration of the supplying of the emission control signal to the emission control line is longer than the duration of the supplying of the first scan signal to the first scan line.

13. The organic light emitting display device as claimed in claim 9, wherein the scan driving part sequentially supplies the first scan signals to the first scan lines, sequentially supplies the second scan signals to the second scan lines, and sequentially supplies the emission control signals to the emission control lines.

14. A method for driving an organic light emitting diode in a pixel circuit of an organic light emitting display device, the pixel circuit including a driving transistor for providing a driving current corresponding to a data voltage to the organic light emitting diode, an initialization transistor for providing a reference voltage to the driving transistor, a data transistor for providing the data voltage to the driving transistor, a diode-coupling switch for diode coupling the driving transistor, and a capacitor having a first terminal and a second terminal for providing a gate voltage corresponding to the data voltage to the driving transistor, the pixel circuit receiving power for generating the driving current from a first power source, the method comprising:

initializing the gate voltage of the driving transistor coupled to the second terminal of the capacitor by turning on the initialization transistor to couple the gate of the driving transistor to the reference voltage through the diode-coupling switch;

supplying the data voltage to the first terminal of the capacitor by turning on the data transistor;

charging the capacitor to a voltage including a threshold voltage of the driving transistor and the data voltage;

providing the driving current to the organic light emitting diode through the driving transistor, the driving current being controlled by the voltage charged in the capacitor; and providing a path for a leakage current leaking during off periods of the initialization transistor substantially from a drain electrode of the driving transistor through the initialization transistor to a source of the reference voltage.

15. The method of claim 14 wherein the providing the path for the leakage current is performed by coupling the initialization transistor to the gate of the driving transistor through the drain electrode of the driving transistor.

16. The method of claim 14, wherein the charging of the capacitor to the voltage including the threshold voltage of the driving transistor and the data voltage includes:

charging the capacitor to a voltage of the first power source minus the data voltage and minus the threshold voltage of the driving transistor.

17. The method of claim 14, wherein the charging of the capacitor to the voltage including the threshold voltage of the driving transistor and the data voltage includes:

reducing a voltage of the first power source by the threshold voltage of the driving transistor by supplying the voltage of the first power source to the second terminal of the capacitor through the driving transistor while diode-coupled;

floating the second terminal of the capacitor by turning off the diode-coupling switch; and reducing the voltage at the first terminal of the capacitor to the reference voltage by turning off the data transistor and coupling the first terminal to the reference voltage.

18. The method of claim 17, wherein the providing of the driving current to the organic light emitting diode through the driving transistor includes:

closing a switch on a path from the driving transistor to the organic light emitting diode substantially simultaneously with the reducing of the voltage at the first terminal of the capacitor to the reference voltage.

19. The method of claim 14, wherein the initializing of the gate voltage of the driving transistor and the supplying of the data voltage to the first terminal of the capacitor begin substantially simultaneously and are performed during partially overlapping periods, and wherein the initializing of the gate voltage of the driving transistor and the second terminal of the capacitor is stopped before the supplying of the data voltage to the first terminal of the capacitor is stopped.

20. The method of claim 19, further comprising:

initializing the first terminal of the capacitor before initializing the gate voltage of the driving transistor and the second terminal of the capacitor, wherein the providing of the driving current to the organic light emitting diode through the driving transistor is performed after a time delay occurring after the supplying of the data voltage to the first terminal of the capacitor is stopped.

* * * * *